United States Patent [19]

MacTurk

[11] 3,955,161

[45] May 4, 1976

[54] MOLDED WAVEGUIDE FILTER WITH INTEGRAL TUNING POSTS

[75] Inventor: William L. MacTurk, Claremont, Calif.

[73] Assignee: General Dynamics Corporation, Pomona, Calif.

[22] Filed: Jan. 13, 1975

[21] Appl. No.: 540,639

Related U.S. Application Data

[60] Division of Ser. No. 494,693, Aug. 5, 1974, Pat. No. 3,896,545, which is a continuation-in-part of Ser. No. 406,058, Oct. 12, 1973, abandoned.

[52] U.S. Cl. ..... 333/73 W; 333/98 R

[51] Int. Cl.[2] ..... H01P 1/20; H01P 3/12; H01P 11/00

[58] Field of Search ..... 333/73 W, 98 R, 31 A, 333/82 B, 83 R; 29/600

[56] References Cited

UNITED STATES PATENTS

| | | | |
|---|---|---|---|
| 2,761,137 | 8/1956 | Van Atta et al. | 343/771 |
| 3,505,618 | 4/1970 | McKee | 333/73 R |

FOREIGN PATENTS OR APPLICATIONS

| | | | |
|---|---|---|---|
| 733,359 | 7/1955 | United Kingdom | 333/98 |

*Primary Examiner*—Alfred E. Smith
*Assistant Examiner*—Marvin Nussbaum
*Attorney, Agent, or Firm*—Albert J. Miller; Edward B. Johnson

[57] ABSTRACT

A molded plastic waveguide filter having a substantially U-shaped filter body with integral tuning posts shorter than the walls thereof and a substantially flat filter cap affixed to the walls of the filter body.

2 Claims, 13 Drawing Figures

FIG. 1
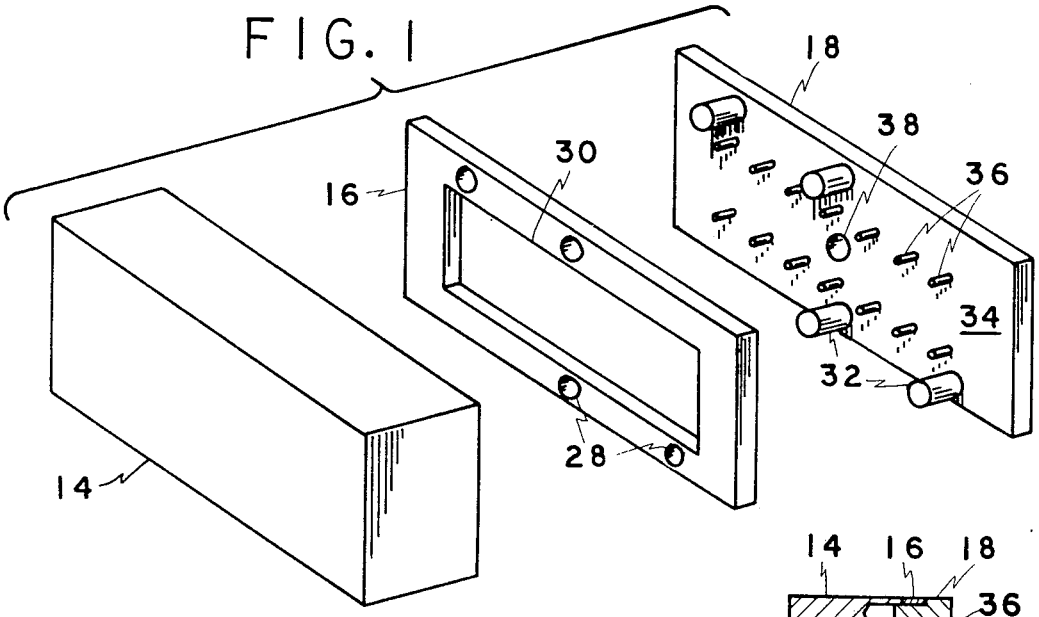
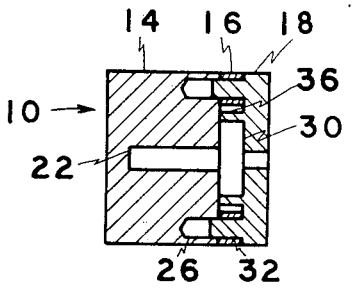
FIG. 3
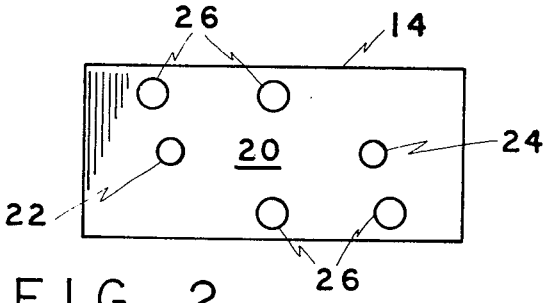
FIG. 2
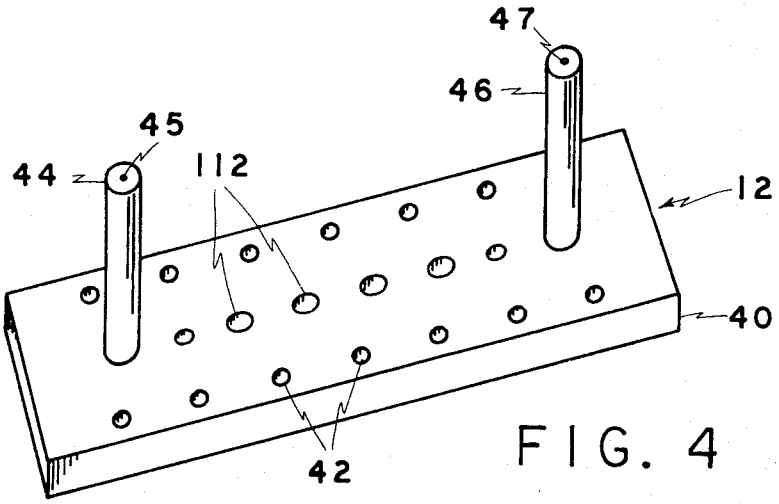
FIG. 4

MOLDED WAVEGUIDE FILTER WITH INTEGRAL TUNING POSTS

CROSS REFERENCE TO RELATED APPLICATIONS

This application is a division of U.S. Pat. Ser. No. 494,693 filed Aug. 5, 1974, now U.S. Pat. No. 3,896,545 which in turn is a continuation-in-part of U.S. Pat. Ser. No. 406,058 filed Oct. 12, 1973, now abandoned.

BACKGROUND OF THE INVENTION

Waveguides of various electrical characteristics are widely employed in the reception and transmission of electromagnetic waves. One of the many applications found for such waveguides has been missile systems in which size, weight and reliability are extremely important considerations.

While metal waveguides, such as disclosed in U.S. Pat. Nos. 2,592,614; 3,261,078, and 3,314,130 are suitable for many applications, their weight makes them unsatisfactory for missile applications. Thus, metal coated glass cloth, elastomer, and plastic waveguides such as described in U.S. Pat. Nos. 2,826,524; 3,290,762; and 2,870,524 have been developed.

When, however, it is desirable to utilize a waveguide as a frequency band pass filter, it is necessary that tuning posts be provided in the interior of the hollow waveguide. Conventional waveguide filters are heavy metal devices machined from aluminum, brass, or copper bronze alloys and containing numerous metal tuning posts. The tuning posts are normally made by inserting metal pins into the metal waveguide and soldering the pins in place. Besides being costly to machine, requiring close mechanical tolerances, and not being conducive to manufacture under production conditions, electrical manfunctions were rather common place from excess solder, pin displacement from soldering temperatures and tolerance error buildup.

With other than metal waveguides, no satisfactory method has been found to provide the tuning posts in the interior thereof. In addition those patents mentioned above the following patents were cited in U.S. Pat. Ser. No. 406,058: U.S. Pat. Nos. 3,713,051; 3,696,314; 1,485,061; 3,496,498; and Great Britain Pat. No. 798,519.

SUMMARY OF THE INVENTION

The invention is directed to plated, molded plastic waveguide filter in which a flat filter cap is affixed to the open end of a U-shaped filter body having integral tuning posts extending therein. Adjustable metal tuning screws extend through the filter cap into a gap over the tuning posts which are shorter than the walls of the U-shaped filter body.

BRIEF DESCRIPTION OF THE DRAWINGS

FIG. 1 is an exploded view of the mold apparatus for the waveguide filter cap;

FIG. 2 is a plan view of the interior face of the mold of the mold apparatus of FIG. 1;

FIG. 3 is a cross-sectional view through the mold cavity of the waveguide filter cap mold apparatus of FIG. 1;

FIG. 4 is a perspective view of a waveguide filter cap produced with the mold apparatus of FIGS. 1–3;

DESCRIPTION OF THE PREFERRED EMBODIMENTS

Figure 5:
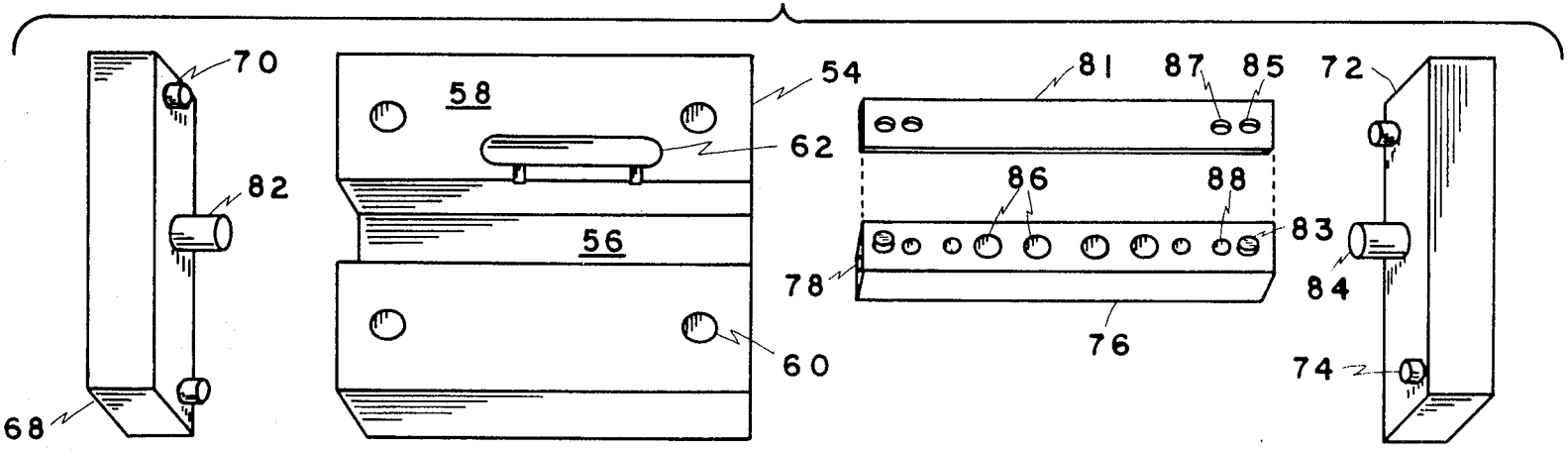
FIG. 5 is an exploded view of the mold apparatus for the waveguide filter body.
Figure 7:
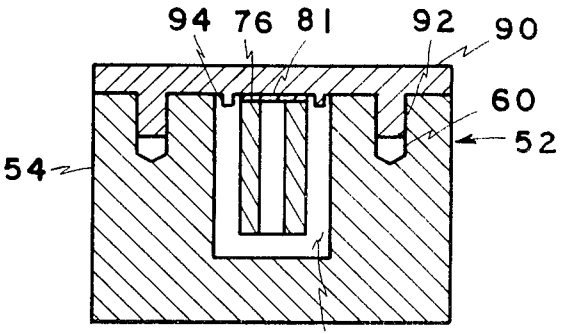
FIG. 7 is a widthwise cross-sectional view of the mold cavity of the waveguide filter body mold apparatus of FIGS. 5 and 6.
Figure 6:
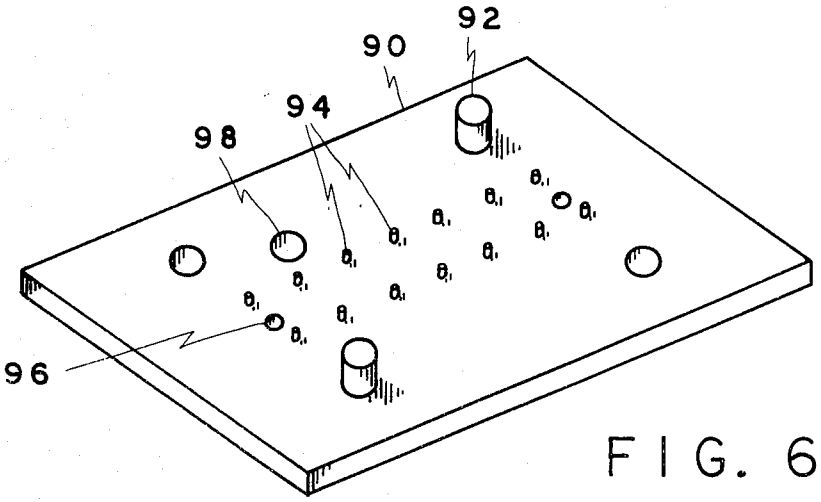
FIG. 6 is a perspective view of the mold cover for the waveguide filter body mold apparatus of FIG. 5.
Figure 8:
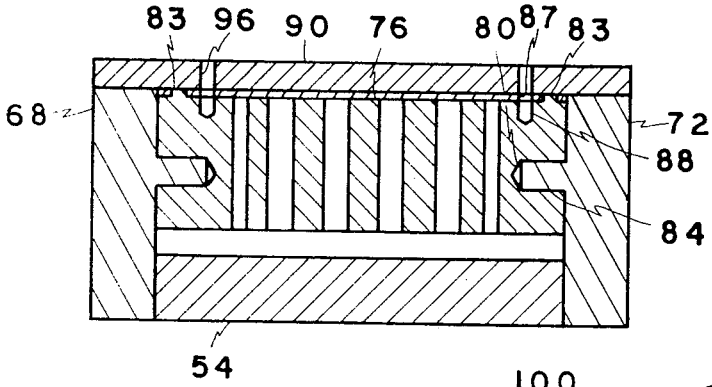
FIG. 8 is a lengthwise cross-sectional view of the mold cavity of the waveguide filter body mold apparatus of FIGS. 5 and 6.

The steel mold assembly 10 shown in FIGS. 1–3 is used to form the waveguide filter cap 12 of FIG. 4. The mold assembly 10 basically comprises the mold 14, central plate 16, and cover plate 18.

The mold 14 is generally rectangular in form and includes a plurality of holes partially therethrough extending from the interior surface 20 thereof. As shown in FIG. 2, an input feed post opening 22 and output feed post opening 24 are provided at opposite ends of the interior surface 20. In addition, a number of mounting holes 26 are provided around the periphery of the interior surface 20 of the mold 14.

The central plate 16 includes a like number of mounting holes 28 extending therethrough and individually aligned with the corresponding mounting holes 26 in the mold 14. A rectangular opening 30 in the central plate 16 provides the cavity for the main body or base 40 of waveguide filter cap 12.

A plurality of mounting pins 32, corresponding in number to the number of mounting holes 26 and 28 and aligned therewith, are disposed on the interior surface 34 of the cover plate 18. The pins 32 have a length greater than the thickness of the central plate 16 so as to extend through the mounting holes 28 in the central plate 16 and into the mounting holes 26 in the mold 14. In addition, a plurality of pins 36 project outward from the interior surface 34 of the cover plate 18 into the cavity 30 of the central plate 16. The pins 36 have a length equal to the thickness of the central plate 16. A molding port 38 also extends through the cover plate 18 into the cavity 36.

As best shown in FIG. 3, the mold assembly 10 is formed by aligning the mounting holes 26 of the mold 14 and the mounting holes 28 of the central plate 16 with the mounting pins 32 of the cover plate 18. A clamp means (not shown) may be utilized to hold the mold assembly together if desired.

As stated previously, the base 40 of the waveguide filter cap 12 is formed in the cavity 30 in the central plate 16 between the mold 14 and the cover plate 18. The plurality of holes 42 which extend through the base 40 result from the pins 36 in the cavity 30. The input post 44 and output post 46 which extend from the base 40 are formed in the input feed post opening 22 and the output feed post opening 24 respectively, both in the mold 14 and communicating with the cavity 30.

The waveguide filter cap 12 is formed by the injection of molten plastic under pressure into cavity 30 through the port 38 in the cover plate 18. A Lustran ABS plastic at 425°F at an injection pressure of 600 psig was injected through a cycle time of 60 seconds, made up of injection and boost for 28 seconds and then a holding time of 32 seconds.

Figure 9:
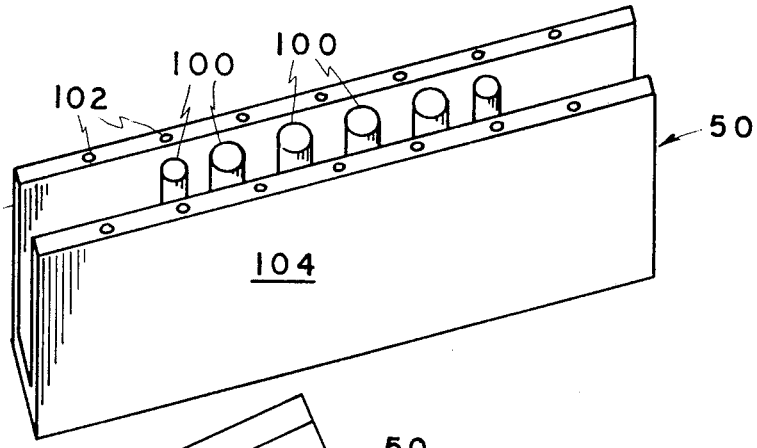
FIG. 9 is a perspective view of a waveguide filter body produced with the mold apparatus of FIGS. 5–8.
Figure 10:
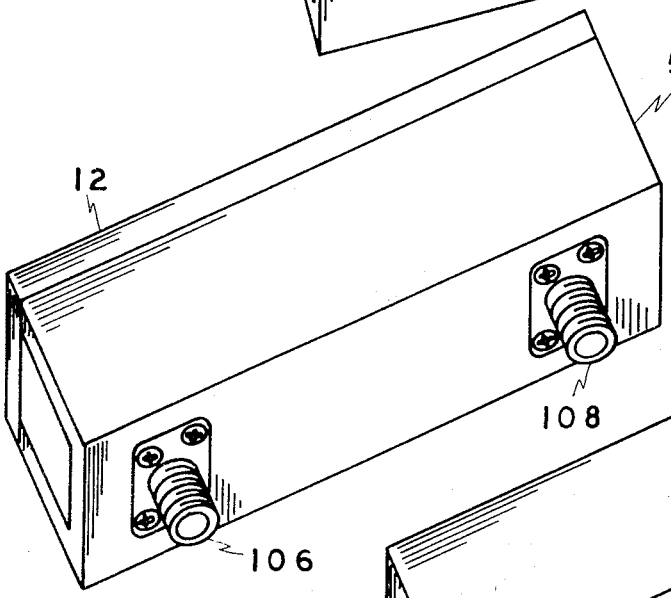
FIG. 10 is a perspective view of a waveguide filter assembled from the waveguide filter cap and waveguide filter body and showing the input and output connectors.
Figure 11:
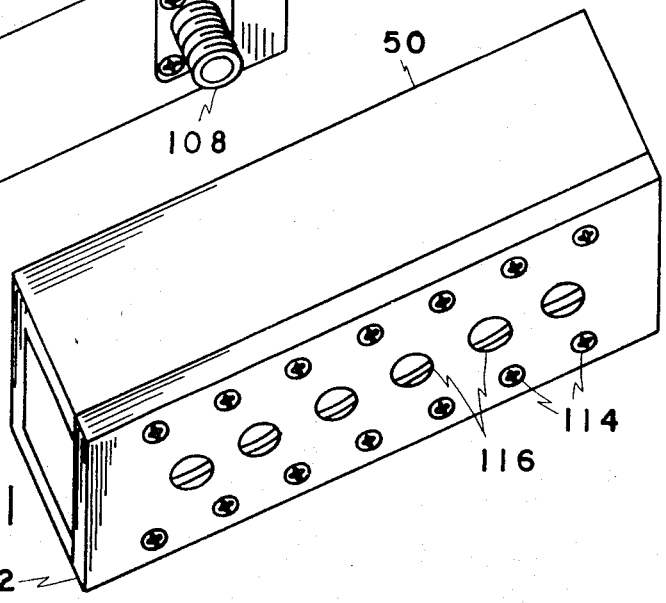
FIG. 11 is a perspective view of the waveguide filter of FIG. 10 showing the tuning screws.

The waveguide filter body 50 shown in FIG. 9 is formed in the steel mold assembly 52 of FIGS. 5–8. The mold 54 is a generally rectangular structure having a deep central slot or mold cavity 56. The top surface 58 includes a plurality of mounting holes 60 and a molding fill hole 62 communicating with the cavity 56. Additionally each end of the mold 54 includes a plurality of mounting holes.

End plate 68 having mounting pins 70 to engage mold end mounting holes is disposed at one end of the mold 54 while end plate 72 having mounting pins 74 to engage mold end mounting holes is disposed at the opposite end of the mold 54.

An internal mandrel 76 having end mounting holes 78 and 80 is suspended in the cavity 56 of the mold 54 between the end plates 68 and 72. Mounting pin 82 projecting from end plate 68 into mandrel hole 78 and mounting pin 84 projecting from end plate 72 into mandrel hole 80 position the mandrel 76 in the cavity 56.

A plurality of tuning post holes 86 vertically extend through the mandrel 76. Vertically extending positioning holes 88 partially extend downward into the mandrel 76 at either end thereof. Disposed over the mandrel 76 is a thin shim 82. This shim 82 is positioned on the mandrel 76 by means of upwardly extending pins 83 on the mandrel 76 which extend through holes 85 in the shim 81. The shim 81 also includes positioning holes 87 aligned with the positioning holes 88 in the mandrel 76. A cover plate 90 is disposed over the mold 54 and includes mounting pins 92 aligned with the mounting holes 60 on the top surface 58 of the mold 54. Additionally the cover plate 90 includes positioning holes 96 aligned with the positioning holes 87 in the shim 81 and positioning holes 88 of the mandrel 76 and a molding port 98 aligned with the molding fill hole 62 in the top surface 58 of the mold 54. A plurality of pins 94 project from the cover plate 90 into the cavity between the mandrel 76 and the mold 54.

The mold assembly 52 is formed by assemblying the mold 54 and internal mandrel 76 with shim 84 between end plates 68 and 72 and then placing the cover plate 90 on the top thereof. Pins may be inserted through the positioning holes 96 in the cover plate 90, the positioning holes 87 in the shim 81, to the positioning holes 88 in the mandrel 76. Clamp means may also be required.

The mold cavity formed in the mold assembly 52 is an elongated U-shape, there being clearance between both the sides and the bottom of the internal mandrel 76 and the cavity 56 in the mold 54. This forms the U-shaped waveguide filter body 50 while the tuning post holes 86 in the mandrel form the plurality of tuning posts 100. The pins 94 in the cover plate 90 produce holes 102 at the top of each of the walls 104 of the U-shaped waveguide filter body 50. The shim 81 produces tuning posts which are slightly shorter, e.g., 0.015 inches, than the walls 104.

A Lustran ABS plastic was injected into the mold assembly 52 to form the waveguide body and posts in the same molding sequence used to form the waveguide cap 12. The injection pressure is, however, increased from 600 psig to 800 psig.

Following individual molding, the mold assemblies 10 and 52 are disassembled and the waveguide filter cap 12 and waveguide filter body 50 removed. Any plastic flash is then removed from the molded parts.

In order to connect the OSM input and output connectors 106 and 108 to the base of the U-shaped waveguide filter body 54, a plurality of holes are drilled opposite the input and output posts 44 and 46 respectively. Input and output posts 44 and 46 are also drilled to form holes 45 and 47 respectively to accept the OSM connector pins. In addition, the holes 102 in the walls of the body 50 are tapped. A buttressing mandrel (not shown) may be utilized to maintain the required perpendicularity of the waveguide walls 104 during this drilling and tapping of the holes. Additionally, a plurality of holes, equal to the number of tuning posts, are drilled and tapped in the base 40 of the waveguide filter cap 12, one hole being opposite each tuning post 100. Alternately each of these holes described above may be molded into the waveguide filter cap 12 and waveguide filter body 50 by providing additional pins in the mold assemblies 10 and 52, respectively.

After the drilling and tapping of the holes has been completed, the entire waveguide filter body 50 including tuning posts 100 and the entire waveguide filter cap 12 are first copper plated and then gold plated. Prior to the plating, the glossy surface of the molded plastic is removed by a light vapor hone. An electroless copper coating or deposit of approximately $50 \times 10^{-6}$ inch is first applied over the waveguide filter body 50 and the cap 12. An approximately 1 mil thick copper plating is then electrodeposited on the waveguide filter body 50 and cap 12 with an 8 amp load current for 40 minutes in a copper tank. A gold flash of $75 \times 10^{-6}$ inch is then applied for corrosion purposes.

Figure 12:
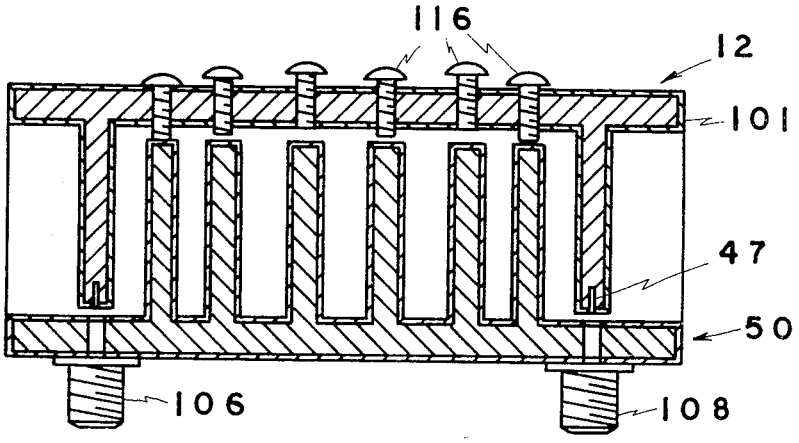
FIG. 12 is a lengthwise cross-sectional view of the assembled waveguide filter of FIGS. 10 and 11 taken through the integral tuning posts.
Figure 13:
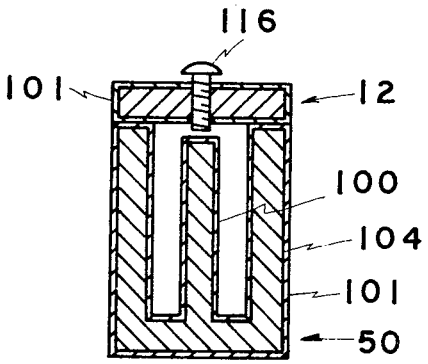
FIG. 13 is a crosswise cross-sectional view of the assembled waveguide filter of FIGS. 10 and 11 taken through an integral tuning post.

Once plated, the waveguide filter cap 12 is placed over the waveguide filter body 50 as shown in FIGS. 10 through 13. The plating 101 on the waveguide filter cap 12 and waveguide filter body is illustrated in FIGS. 12 and 13. Screws 114 are used to attach the cap 12 to the body 50. Metal tuning screws 116 are then inserted through holes 112 in the waveguide filter cap 12 into position over the tuning posts 100. The OSM input and output connectors 106 and 108 are screwed into place at the base of the waveguide body 50. This effectively completes the waveguide filter assembly.

Since, as shown in FIGS. 12 and 13, the tuning posts 100 are shorter than the walls 104 of the waveguide filter body 50, there is a gap between the top of the posts 100 and the waveguide filter cap 12. The metal tuning screws 116 can be positioned to extend varying distances into this gap. This enables tuning of the waveguide filter to provide the proper bandpass and frequency response by inductively or capacitively coupling each tuning post by adjusting each tuning screw. Filters produced by the process of the present invention are lightweight and susceptible to production manufacture. These plastic waveguide filters are less than half as heavy as a comparable metal waveguide filter and are considerably less expensive to produce. They are also much more electrically reliable.

The plastic, including any heat shrinkage, is dimensionally stable to precisely establish the desired filter band pass. The positioning of the tuning post can be made accurate to .0005 inches, which difference would not be detectable by the electromagnetic field. The center frequency, bandpass, and band width will meet the required engineering specifications. Attentuation versus frequency shows a frequency response within minus 55 db attenuation.

While specific embodiments of the invention have been illustrated and described, it is to be understood that these are provided by way of example only and that the scope of the invention is to be determined by the proper scope of the appended claims.

What I claim is:

1. A molded plastic waveguide filter comprising:

a plated, molded plastic waveguide filter body, substantially U-shaped, and having integral tuning posts extending therein, said tuning posts being shorter than the walls of said U-shaped waveguide body;

a substantially flat, plated, molded plastic waveguide filter cap disposed over the open end of said U-shaped waveguide filter body and affixed to the walls of said waveguide filter body leaving a gap between the shorter tuning posts and the cap; and adjustable metal tuning screws extending through said waveguide filter cap into the gap over the tuning posts.

2. The filter of claim 1 wherein said gap is approximately 0.015 inch.

* * * * *